US006836064B2

(12) United States Patent
Yamada et al.

(10) Patent No.: US 6,836,064 B2
(45) Date of Patent: Dec. 28, 2004

(54) GAS DISCHARGE TUBE AND DISPLAY DEVICE USING THE SAME

(75) Inventors: Hitoshi Yamada, Kawasaki (JP); Akira Tokai, Kawasaki (JP); Manabu Ishimoto, Kawasaki (JP); Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/105,218

(22) Filed: Mar. 26, 2002

(65) Prior Publication Data

US 2003/0048068 A1 Mar. 13, 2003

(30) Foreign Application Priority Data

Sep. 12, 2001 (JP) ..... 2001-276941

(51) Int. Cl.[7] ..... H01J 63/04

(52) U.S. Cl. ..... 313/485; 313/483; 313/484; 313/610

(58) Field of Search ..... 313/607, 483, 313/484, 485, 486, 26, 17, 582, 583, 584, 585, 586, 587, 25, 292, 283, 493, 492, 238, 610, 611, 612, 609; 362/260; 445/26

(56) References Cited

U.S. PATENT DOCUMENTS

| | | | | | |
|---|---|---|---|---|---|
| 2,363,070 | A | * | 11/1944 | Lemmers | 313/634 |
| 3,602,754 | A | * | 8/1971 | Pfaender et al. | 313/586 |
| 3,848,150 | A | * | 11/1974 | Taxil et al. | 313/484 |
| 4,956,577 | A | * | 9/1990 | Parker | 313/634 |
| 6,018,218 | A | * | 1/2000 | Terada et al. | 313/488 |
| 6,331,064 | B1 | * | 12/2001 | Nishiyama et al. | 362/260 |
| 6,577,060 | B2 | | 6/2003 | Tokai et al. | |

* cited by examiner

*Primary Examiner*—Edward J. Glick
*Assistant Examiner*—Elizabeth Keaney
(74) *Attorney, Agent, or Firm*—Staas & Halsey LLP

(57) ABSTRACT

A gas discharge tube having a phosphor layer formed within a tubular vessel defining a discharge space. The gas discharge tube includes a supporting member independent of the tubular vessel. The phosphor layer is formed on the supporting member. The supporting member is inserted within the discharge space.

7 Claims, 11 Drawing Sheets

GAS DISCHARGE TUBE AND DISPLAY DEVICE USING THE SAME

BACKGROUND OF THE INVENTION

1. Field of the Invention

The present invention relates to a gas discharge tube. More particularly, the present invention relates to an elongated gas discharge tube having a diameter of about 0.5 to 5 mm.

2. Description of the Related Art

In conventional elongated gas display tubes, a phosphor (fluorescent) layer is formed within the tube by introducing a phosphor slurry (coating solution containing a phosphor powder) into the tube, coating the slurry on an internal surface of the tube, and firing the slurry to burn out organic components of the slurry.

Firing is easily performed if the tube has a diameter (4 mm or more) large enough to have a low resistance to introduction of the air into the tube (high conductance).

Meanwhile, display devices for displaying desired images are known in which a plurality of elongated gas discharge tubes are arranged parallel to each other. Such display devices employ elongated gas discharge tubes of a diameter of 0.5 to 5 mm.

Gas discharge tubes of a diameter of 2 mm or less as mentioned above, when a phosphor layer is formed within it, have difficulty in completely burning out organic components even if a phosphor slurry coated on an internal surface of the tube is fired because of a low conductance of air flow through the tube.

Due to this, a discharge gas enclosed in the tube in a later step is contaminated by residues produced from the organic substances in the firing, so that the discharge characteristics of the gas discharge tube are adversely affected. This problem frequently occurs especially with tubes whose length exceeds 300 mm.

SUMMARY OF THE INVENTION

The present invention has been made under the above circumstances, and provides a gas discharge tube comprising a supporting member independent of a tubular vessel, wherein a phosphor layer is formed on the supporting member. The present invention aims that it is possible to form the phosphor layer easily and perform firing outside the tube for forming the phosphor layer, so that a discharge gas is prevented from being contaminated by residues produced after a phosphor slurry is fired. This results in stabilized discharge characteristics and improved luminous efficiency of the gas discharge tube.

A gas discharge tube according to the present invention is constructed so that a phosphor layer is formed on a supporting member independent of a tubular vessel of the gas discharge tube and the supporting member is disposed within a discharge space by inserting the supporting member inside the tubular vessel.

According to the present invention, since the phosphor layer is formed on the supporting member independent of the tubular vessel of the gas discharge tube, it is possible to form a phosphor layer of a uniform thickness easily and perform firing outside the tubular vessel of the gas discharge tube for forming the phosphor layer. This makes it possible to prevent a discharge gas being contaminated by residues produced after a phosphor slurry is fired.

DESCRIPTION OF THE PREFERRED EMBODIMENT

Figure 1:
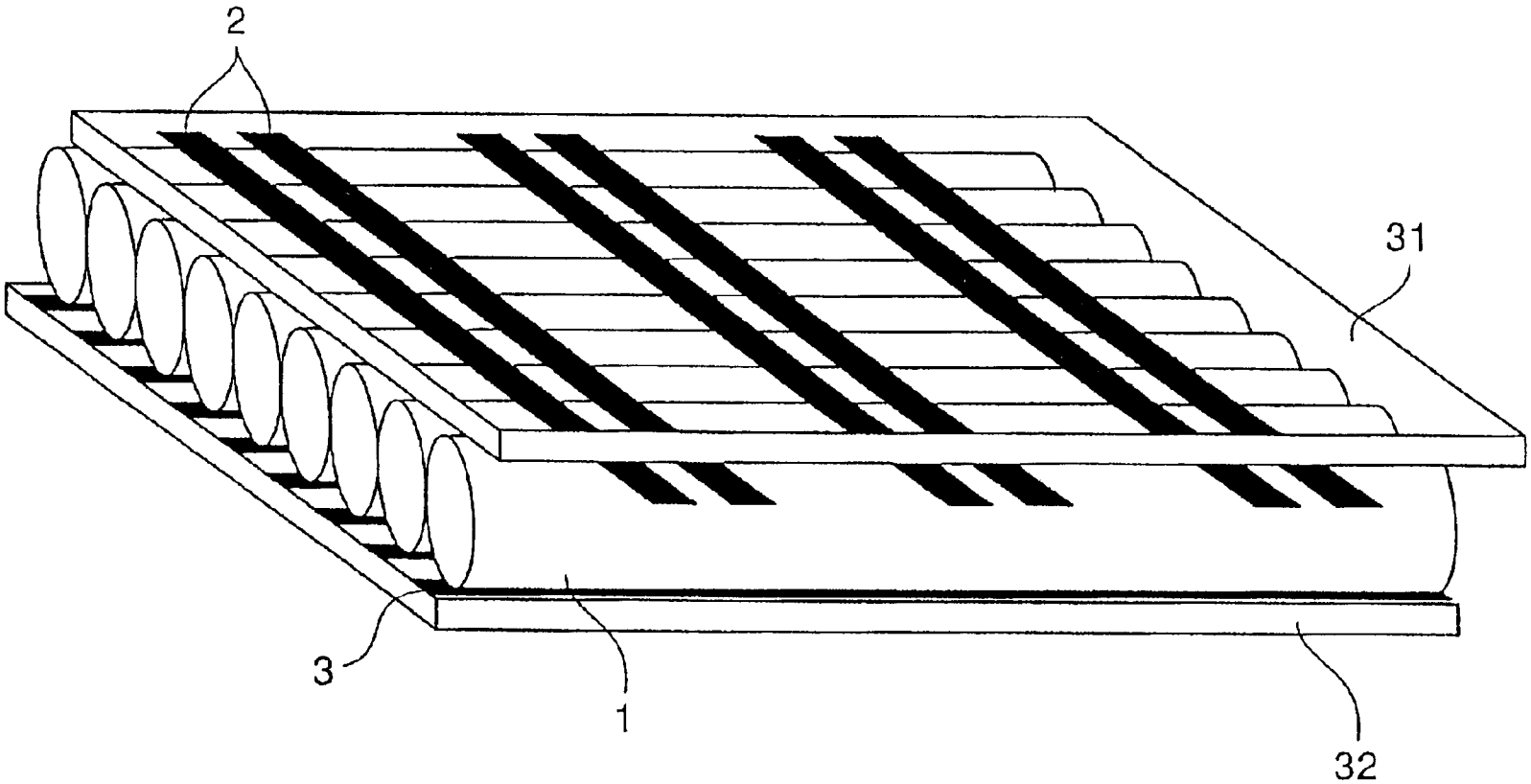
FIG. 1 is an explanatory view illustrating an embodiment of a display device using a gas discharge tube according to the present invention.

The construction of the gas discharge tube according to the present invention can be applied to gas discharge tubes of any diameter, and preferably to elongated gas discharge tubes of a diameter of about 0.5 to 5 mm.

The gas discharge tube according to the present invention is constructed so that the phosphor layer formed on the supporting member is inserted into the discharge tube.

Gas discharge tubes of a small inner diameter have a low conductance of air flow through the tube so that the air cannot sufficiently be supplied in firing of a phosphor slurry coated on an internal surface of the tube even if a phosphor layer is intended to be formed on the internal surface of the tube. Therefore, according to the present invention, outside the tube, the phosphor layer is formed on the supporting member insertable into the tube, before the supporting member is inserted into the tube.

Examples of the material of the supporting member can be any of glass, a metal oxide and a metal. In the case where glass is employed, ends of the supporting member, if the tubular vessel of the tube is made of glass or the like, can be melted and tipped off together with ends of the gas discharge tube for sealing the ends of the tube after introduction of a discharge gas into the tube. Further, since the materials of the tube and the supporting member fit well, it is possible to prevent the tube from being broken.

In the case where a metal oxide is employed, an insulative, thin and rigid supporting member can be obtained. Also, the supporting member can be formed into a desired shape by pressing.

In the case where a metal is employed, a supporting member which also serves as an electrode can be obtained because the supporting member are conductive.

It is desirable that the supporting member comprises at least one of a glass layer, a metal oxide layer and a metal layer. In the case where a metal is employed as an electrode for discharge, it is possible, if the supporting member has a two-layered structure of a metal oxide layer or a glass layer and the metal layer, to prevent the metal layer from being damaged by a discharge.

With respect to fixation of the supporting member in the gas discharge tube, it is desirable that the supporting member is made of a curved plate having an arc-shape section if the tube has a cylindrical shape so that the shape of the supporting member conforms to the inner shape of the tube. This is intended to lower the degree of freedom of the supporting member for fixing the supporting member in the tube.

In the case where the supporting member and the tube are both made of glass, the supporting member may be also fixed in the tube by tipping off the ends of the tube together with the ends of the supporting member for sealing the ends of the tube after introduction of the discharge gas into the tube.

The supporting member may be provided with projections on which the phosphor layer is also formed. When applied to a display device, the gas discharge tube is divided into several areas in a longitudinal direction so that light is emitted from a desired area with an electrode for discharge provided in each area. In this case, luminance can be improved by the projections formed on the phosphor layer due to increase of the surface area of the phosphor layer. Also, if the projections are provided between adjacent luminous areas in the phosphor layer, it is possible to prevent light emitted from a luminous area from leaking out to an adjacent luminous area.

Further, if the projections are formed on the supporting member, it is effective in increasing the mechanical strength of the supporting member.

In the gas discharge tube constructed according to the present invention, the supporting member, in the case where an electrode for discharge is formed outside the tube so that it is opposed to the supporting member, insulates the electrode for discharge against the discharge space, so that the discharge characteristics of the gas discharge tube is affected depending on the material or thickness of the supporting member. Accordingly, by forming an induction electrode or the electrode for discharge on the supporting member, a gas discharge tube can be achieved whose discharge characteristics are not adversely affected. Here, the induction electrode means an electrode capable of generating a discharge by induction from the electrode for discharge.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Gas discharge tubes according to the present invention are appropriately applied, by being arranged parallel to each other, to display devices for displaying desired images. Accordingly, an embodiment of a display device will be described.

FIG. 1 is an explanatory view illustrating an embodiment of a display device using the gas display tubes according to the present invention.

In the drawing, reference numeral 31 indicates a front substrate, 32 a rear substrate, 1 gas discharge the tubes, 2 display electrode pairs (main electrode pairs), and 3 signal electrodes (data electrodes).

Inside the elongated gas discharge tube (within a discharge space), a supporting member having a phosphor layer is inserted, a discharge gas is introduced into the tube, and both ends of the tube 1 are sealed. The signal electrodes 3 are formed on the rear substrate 32 in a longitudinal direction of the tubes 1. The display electrode pairs 2 are formed on the front substrate 31 in a direction crossing the signal electrodes 3. Non-discharge regions (gaps) are provided between adjacent display electrode pairs 2.

In assembly of the display device, the signal electrodes 3 and the display electrode pairs 2 are closely contacted with an outer periphery of the tube 1 at an upper side and a lower side, respectively. A conductive adhesive may be interposed between the display electrode 2 and the outer periphery of the tube 1 at the upper side so as to improve the contact therebetween.

An area where the signal electrode 3 intersects the display electrode pair 2 is a unit luminous area, when the display device is viewed in plan. Display is performed as follows. Using, as a scanning electrode, either one electrode of the display electrode pair 2, a selection discharge is generated at the area where the scanning electrode intersects the signal electrode 3, thereby selecting a luminous area. Utilizing a wall charge provided, in accordance with emission of light in the selection discharge, within the tube in the luminous area, display discharges are generated between the display electrode pair 2. A selection discharge is an opposite discharge generated within the tube 1 between the scanning electrode and the signal electrode 3, which are opposed to each other vertically. A display discharge is a surface discharge generated within the tube 1 between the display electrode pair 2, which are disposed parallel to each other on a plane.

Also, such a display device that a large number of gas discharge tubes are arranged parallel to each other may be constructed by previously forming the display electrode pairs 2 in dots and the signal electrodes 3 in stripes on outer surface of the tube 1 by printing, vapor deposition or the like; forming electrodes for supplying electric power both on the front substrate 31 and the rear substrate 32; and respectively contacting, in assembly of the gas discharge tube 1, the electrodes for supplying electric power with the display electrode pairs 2 and the signal electrodes 3.

Figure 2:
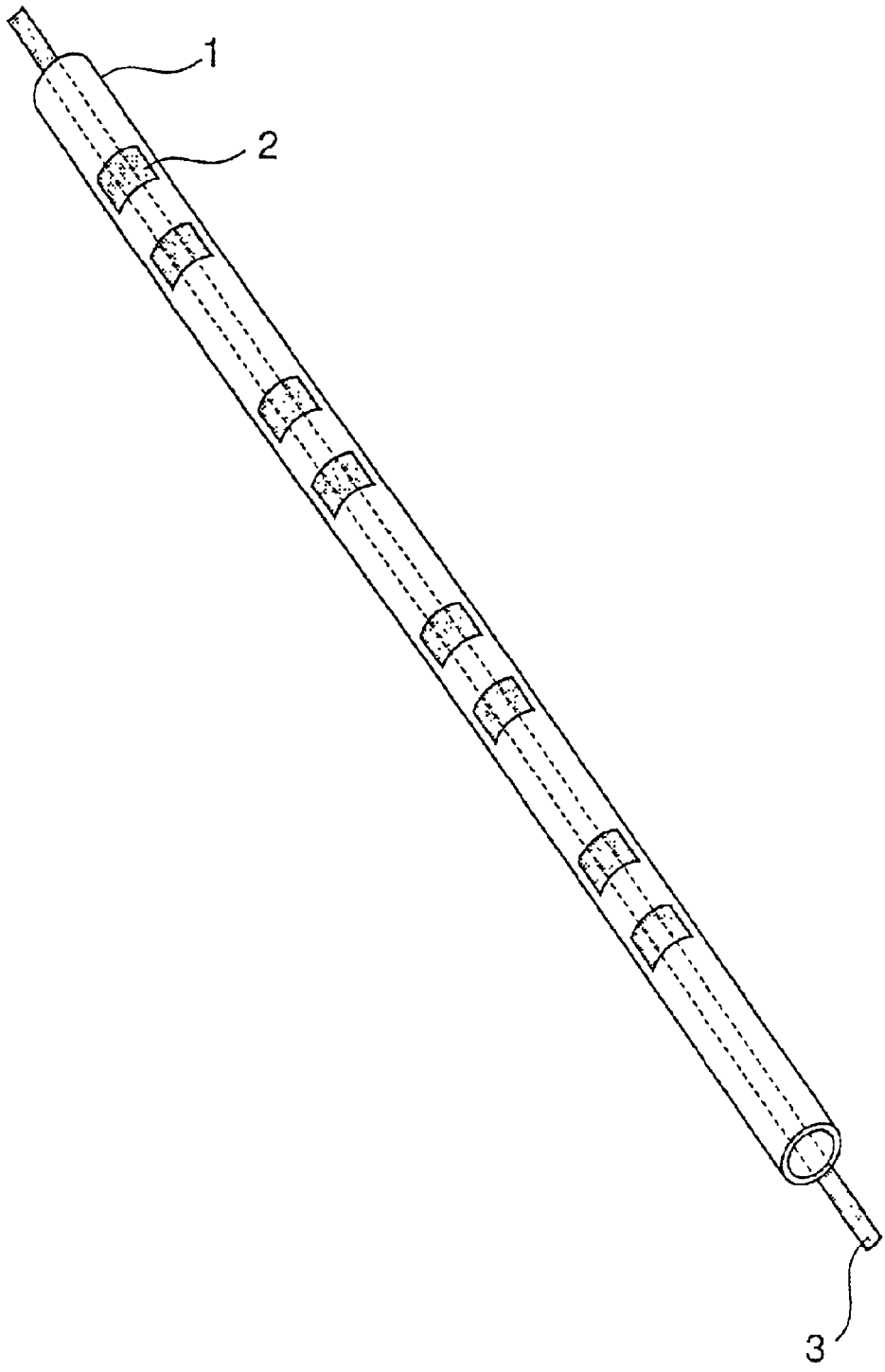
FIG. 2 is a view illustrating an embodiment of the gas discharge tube.

FIG. 2 is a view illustrating an embodiment of the gas discharge tube 1 with outer surfaces on which the display electrode pairs 2 in dots and the signal electrodes 3 in strips are formed.

Figure 3:
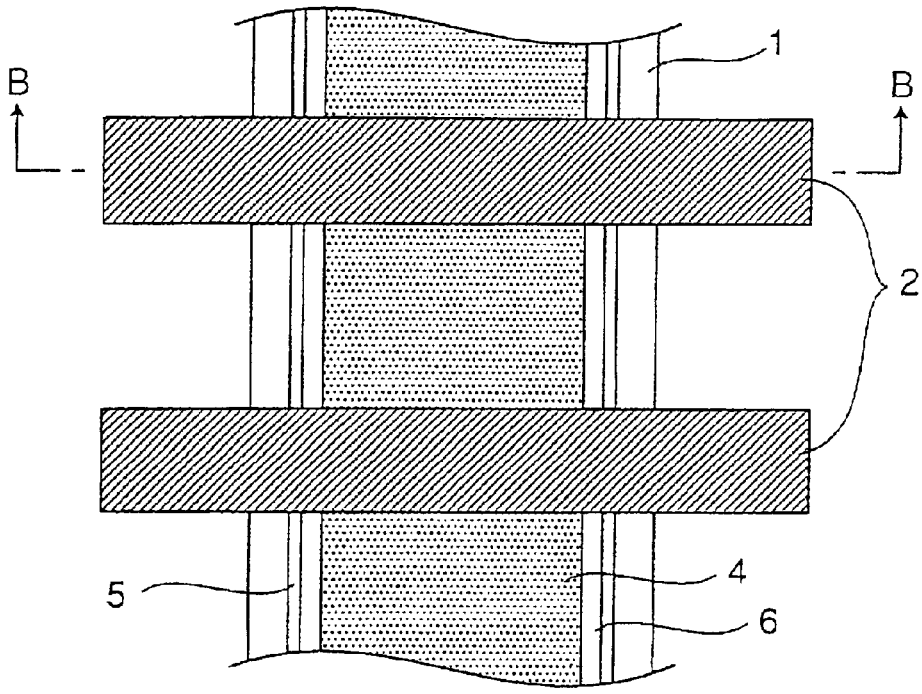
FIGS. 3(*a*) and 3(*b*) are explanatory views illustrating in detail the construction of the gas discharge tube of FIG. 1.
Figure 3:
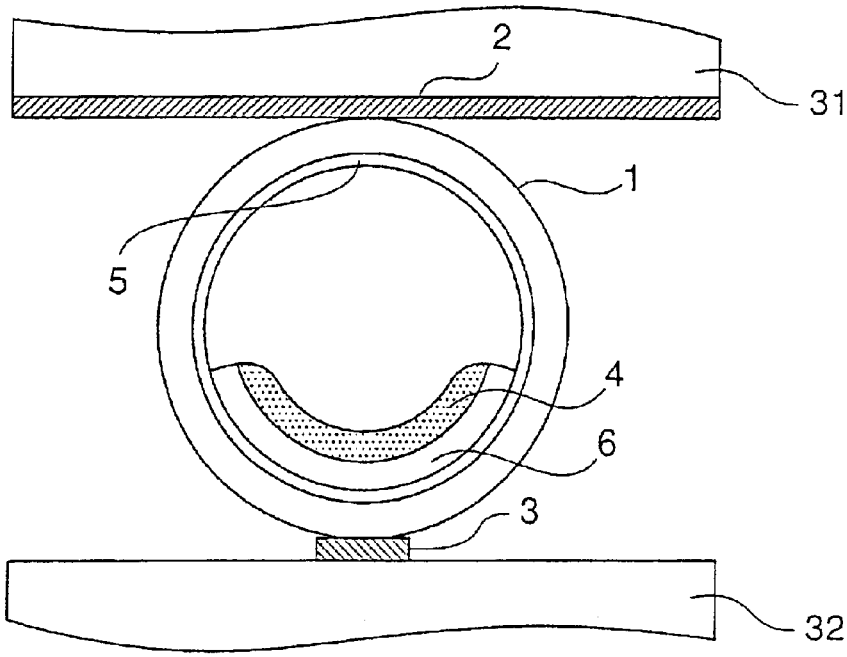

FIGS. 3(*a*) and 3(*b*) are explanatory views illustrating in detail the construction of the gas discharge tube 1 of FIG. 1. FIG. 3(*a*) is a plan view illustrating a portion of the gas discharge tube 1 adjacent to the display electrodes 2. FIG. 3(*b*) is a cross-sectional view taken along line B—B of FIG. 3(*a*). In the drawings, reference numeral 4 indicates a phosphor layer, 5 an electron emission layer of MgO, and 6 a supporting member.

The gas discharge tubes 1 according to the present invention are constructed so that, using discharges generated across the plurality of display electrode pairs 2 disposed in contact with outer surfaces of the tubes 1, light is emitted from the phosphor layers, thereby obtaining a plurality of luminous areas (display areas) within the single tube 1. The gas discharge tube 1 of the present invention is made of a transparent insulating material (borosilicate glass) and has a diameter of 2 mm or less and a length of 300 mm or more.

The supporting member 6 is made also of borosilicate glass and independent of the tubular glass vessel of the tube 1, and the phosphor layer 4 is formed on the supporting member 6. Accordingly, it is possible that outside the tube 1, a phosphor paste is coated on the supporting member 6 and fired so as to form the phosphor layer 4 on the supporting member 6, followed by inserting the supporting member 6 into the glass tube 1. The phosphor paste can be any phosphor paste known in the art.

Application of a voltage to the display electrode pair 2 and the signal electrode 3 allows a discharge to be generated in the discharge gas enclosed in the tube 1. In FIGS. 3(*a*) and 3(*b*), three electrodes are arranged at one luminous area so that display charges are generated between the display electrode pair 2, but the manner of generating display discharges is not limited thereto, and display discharges may be generated between the display electrode 2 and signal electrode 3.

In other words, such a construction may be designed that the display electrode pair 2 is used as one electrode and the display electrode 2 thus obtained is used a scanning electrode to generate selection discharges and display discharges (opposite discharges) between the display electrodes 2 and the signal electrodes 3.

The electron emission layer 5 has the function of lowering a breakdown voltage by generating charged particles by its collision with the discharge gas having energy of a predetermined value or above. The electron emission layer 5 is not necessarily needed. The electron emission layer may be provided by forming the electron emission layer on a supporting member for electron emission layer and then inserting the supporting member for electron emission layer into the glass tube, as for the provision of the phosphor layer. Specifically, in the case of a cylindrical supporting member for electron emission layer, the electron emission layer is formed on entire inner wall surfaces of the supporting member for electron emission layer, and the supporting member for phosphor layer is inserted inside the supporting member for electron emission layer thereby to dispose the supporting member for phosphor layer within the discharge space. Also, in the case where the supporting member for phosphor layer and the supporting member for electron emission layer are both of a semicylindrical shape, the supporting member for electron emission layer and the supporting member for phosphor layer are disposed within the discharge space with the inner wall surfaces thereof facing each other by inserting the supporting member for electron emission layer and the supporting member for phosphor layer inside the glass tube. However, in these double structures, the total material thickness of the glass tube and the supporting member for supporting the electron emission layer are required to be the same as the material thickness of the glass tube in the case of the single structure only of the glass tube.

When a voltage is applied to the display electrode pairs 2, the discharge gas enclosed in the tube 1 is excited to emit visible light from the phosphor layer 4 by the phosphor layer 4 receiving vacuum ultraviolet light generated in the course of deexcitation of atoms of the excited rare gas.

Figure 4:
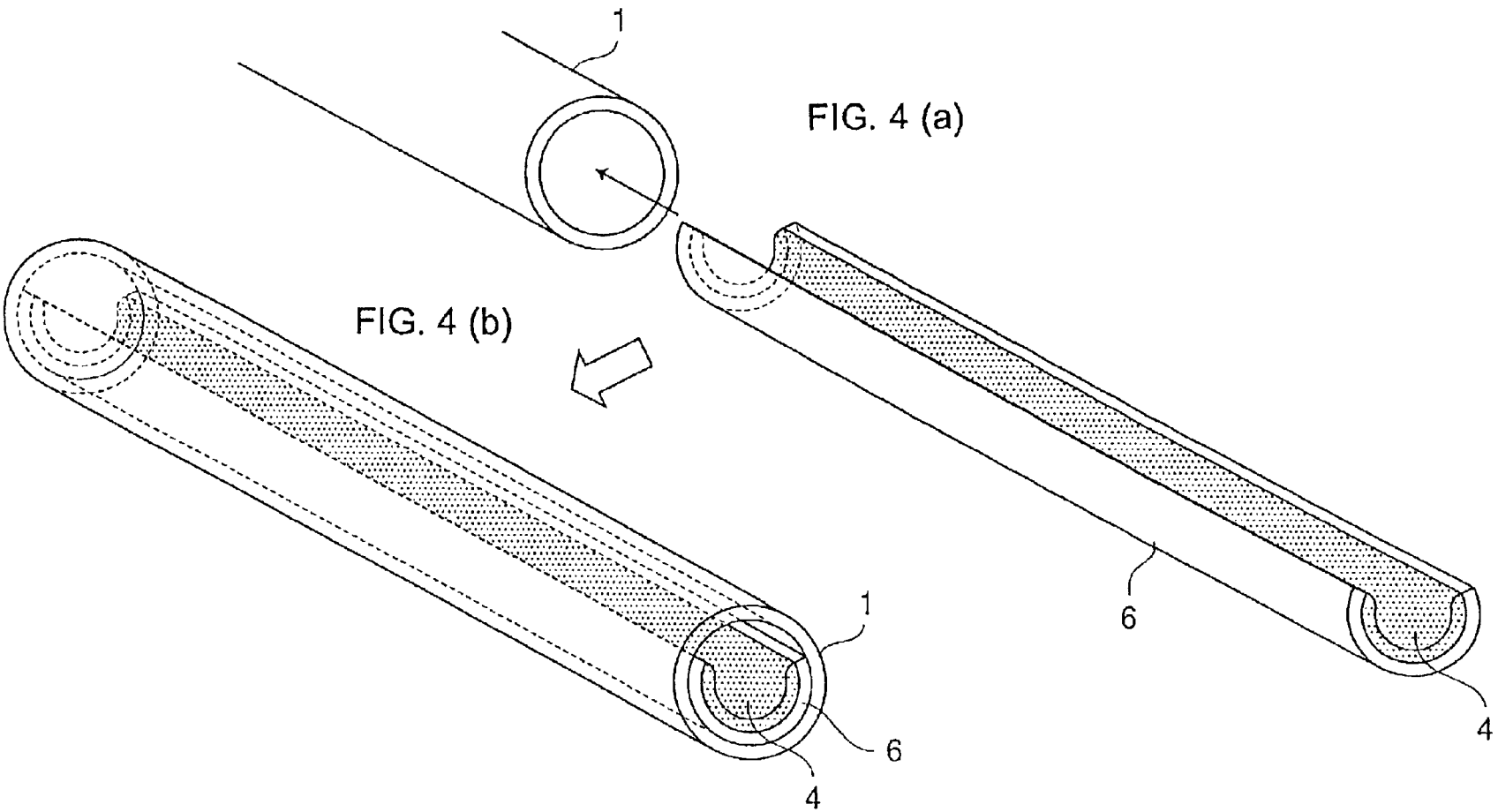
FIGS. 4(*a*) and 4(*b*) are explanatory views illustrating introduction of a supporting member into the gas discharge tube.

FIGS. 4(*a*) and 4(*b*) are explanatory views illustrating insertion of the supporting member 6 into the tube 1.

As shown in the drawings, outside the tubular vessel of the gas discharge tube 1, the phosphor paste is coated on the supporting member 6 and fired so as to form the phosphor layer 4 on the supporting member 6 in conformity in shape. Then, the supporting member 6 thus provided with the phosphor layer 4 is inserted into and fixed in the tube 1. Thus, the tube 1 is obtained which has the phosphor layer 4 inside the tube 1 (within a discharge space).

Figure 5:
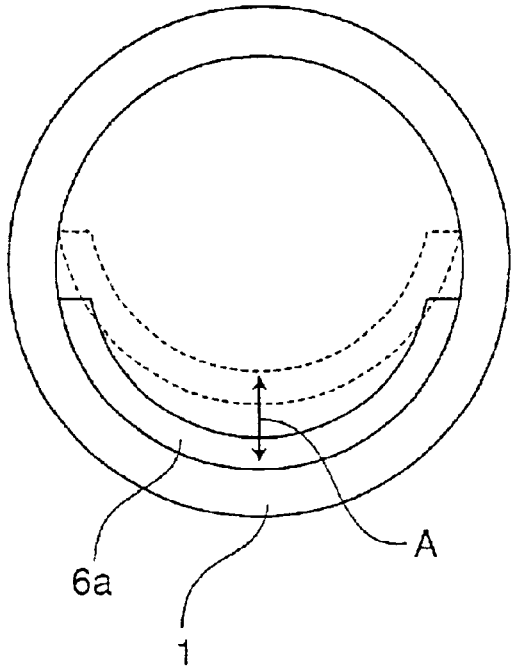
FIG. 5 is an explanatory view illustrating an example of the construction of the supporting member.
Figure 6:
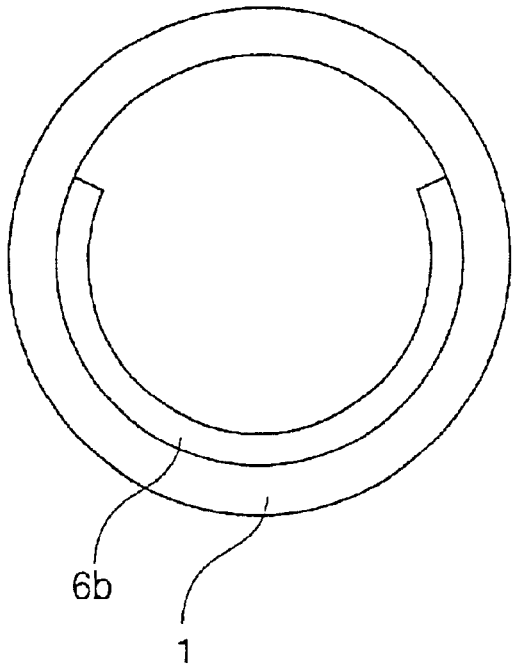
FIG. 6 is an explanatory view illustrating another example of the construction of the supporting member.
Figure 7:
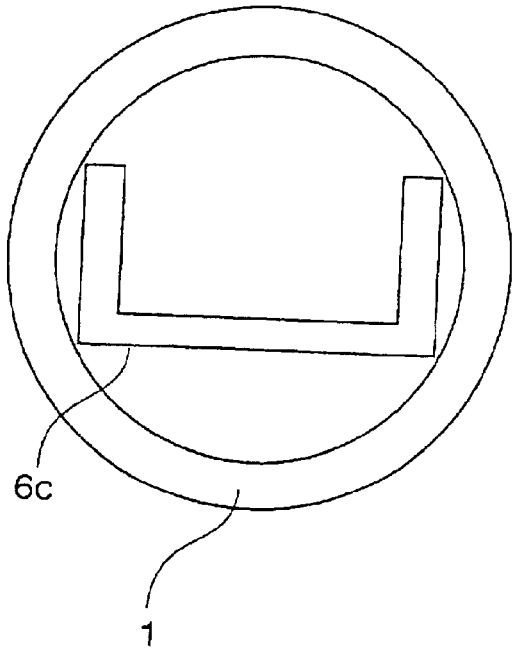
FIG. 7 is an explanatory view illustrating still another example of the construction of the supporting member.

FIGS. 5 to 7 are explanatory views illustrating various examples of the construction of the supporting member 6.

In the case of a supporting member 6*a* whose cross section is semicircularly curved as shown in FIG. 5, the supporting member 6*a* has a smaller area relative to the discharge space formed inside the tube 1. Due to this, the supporting member 6*a* has a higher degree of freedom relative to the gas discharge space so that the supporting member 6*a* is liable to undulate or curve with an utmost height of A in a longitudinal direction of the tube 1, and the discharges characteristics of the gas discharge tube 1 vary widely.

In contrast, in the case of supporting members 6*b* and 6*c* whose cross sections are major-arc shaped and an open-square shaped as shown in FIGS. 6 and 7, respectively, the supporting members 6*b* and 6*c* have a lower degree of freedom, i.e., are stably maintained, and therefore variations in the discharge characteristics can be inhibited. Here, the tube 1 has a circular cross section, but the gas discharge tube according to the present invention is not limited thereto.

Figure 8:
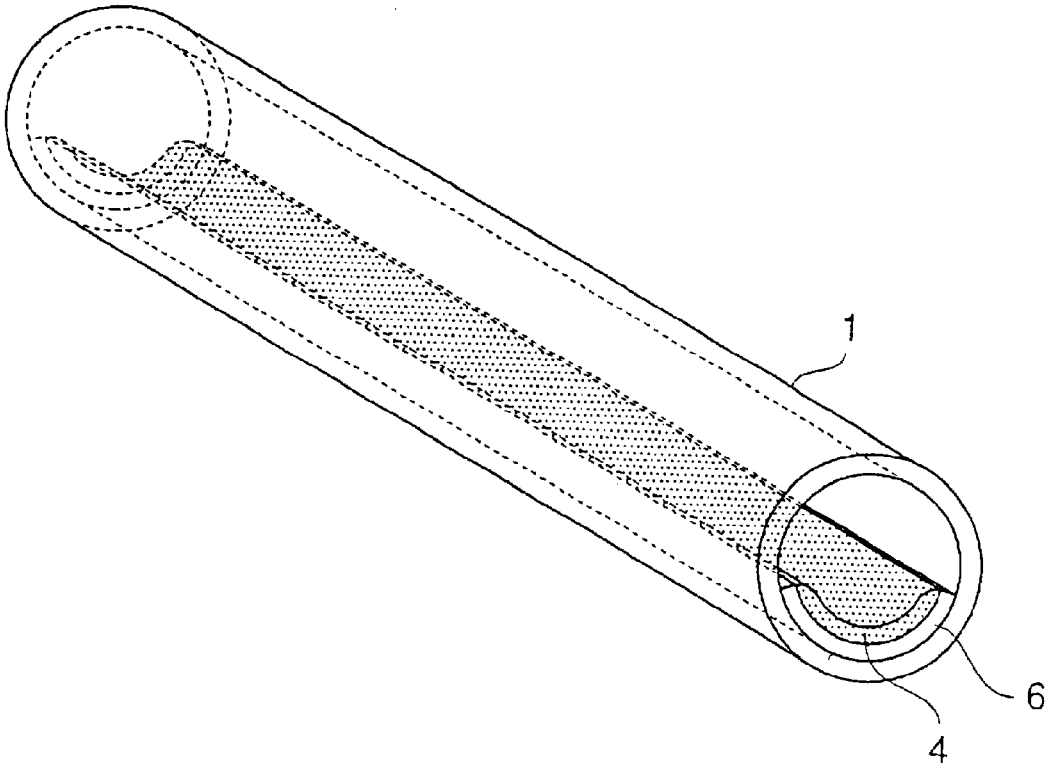
FIG. 8 is an explanatory view illustrating a gas discharge tube into which a supporting member having a phosphor layer is introduced.
Figure 9:
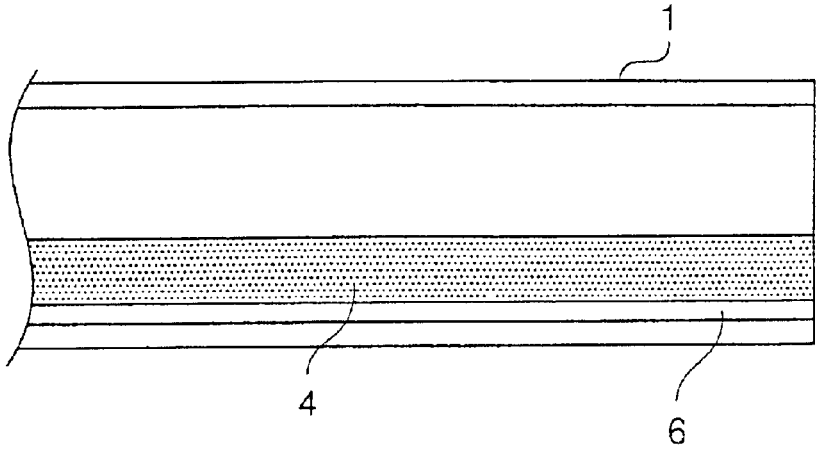
FIGS. 9(*a*), 9(*b*) and 9(*c*) are explanatory views illustrating the gas discharge tube into which the supporting member having the phosphor layer is introduced.
Figure 9:
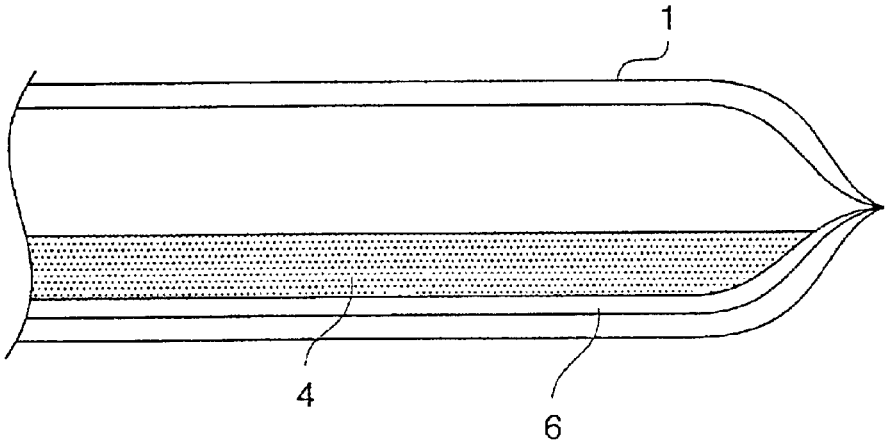
Figure 9:
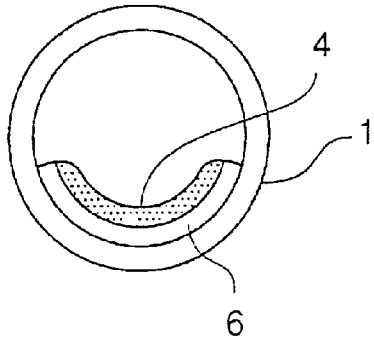

FIG. 8 and FIGS. 9(*a*), 9(*b*) and 9(*c*) are explanatory views illustrating the gas discharge tube 1 into which the supporting member 6 having the phosphor layer 4 is introduced. FIG. 9(*a*) is a side view illustrating an end of the gas discharge tube 1 of FIG. 8, which has not yet been tipped off. FIG. 9(*b*) is a side view illustrating the end of the gas discharge tube, which has already been tipped off. FIG. 9(*c*) is a cross sectional view illustrating the gas discharge tube 1 of FIGS. 9(*a*) and 9(*b*).

As shown in these drawings, the supporting member 6 can be fixed in the tube 1 by tipping off the ends of the tube 1 together with the ends of the supporting member 6 for sealing the ends of the tube 1 after insertion of the discharge gas into the tube 1.

The tubular vessel of the gas discharge tube 1 is a glass tube, and fits to the supporting member 6, which is also made of glass. Therefore, the tube 1 cannot easily be broken even if the supporting member 6 is fixed in the tube 1 by melting the ends of the supporting member 6 together with the ends of the tube 1.

Figure 10:
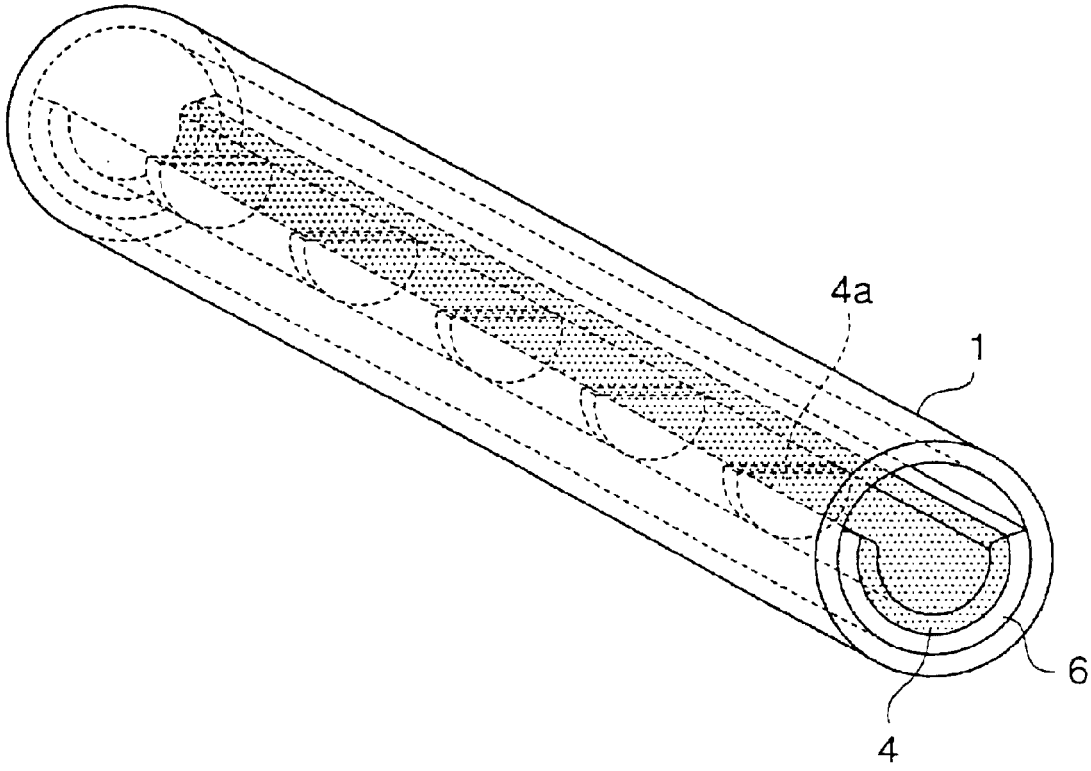
FIG. 10 is a view illustrating a gas discharge tube into which a supporting member having a phosphor layer with projections is introduced.
Figure 11:
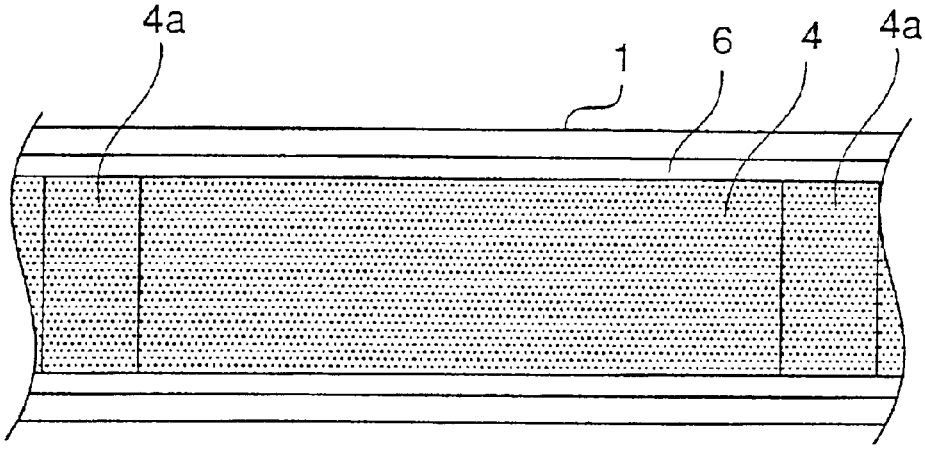
FIGS. 11(*a*), 11(*b*) and 11(*c*) are views illustrating the gas discharge tube into which the supporting member having the phosphor layer with the projections is introduced.
Figure 11:
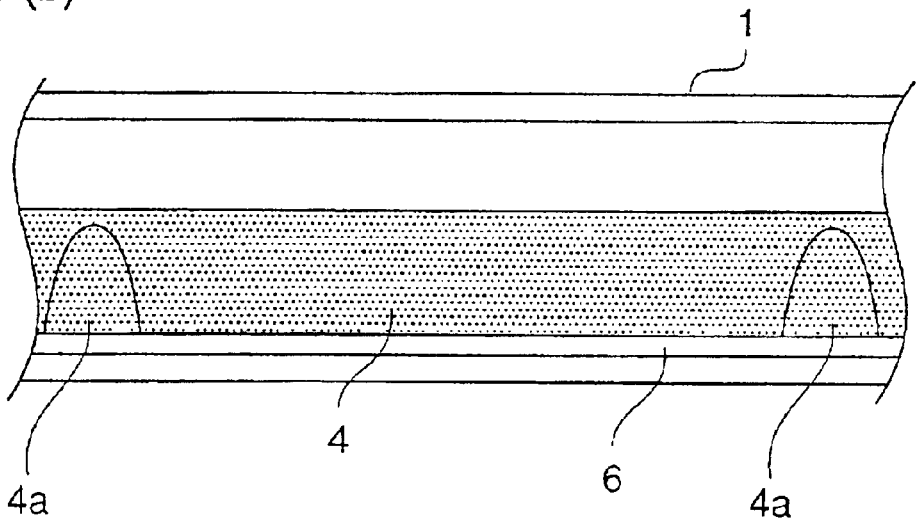
Figure 11:
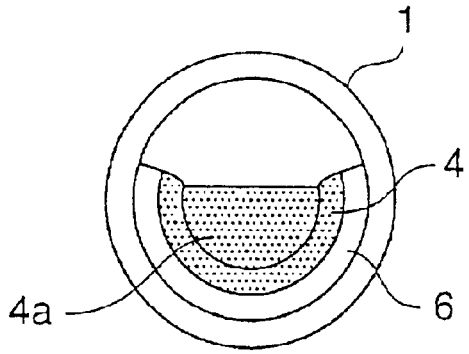

FIG. 10 and FIGS. 11(*a*), 11(*b*) and 11(*c*) are views illustrating the gas discharge tube 1 into which the supporting member 6 having a phosphor layer 4*a* with projections is introduced. FIG. 11(*a*) is a plan view illustrating the gas discharge tube 1 of FIG. 10. FIG. 11(*b*) is a side view illustrating that of FIG. 11(*a*). FIG. 11(*c*) is a cross-sectional view illustrating that of FIG. 11(*b*).

As shown in these drawings, on the supporting member 6, are formed projections which partition the discharge space on a unit luminous area (pixel) basis and, by following the configuration of the projections, the phosphor layer 4, which is formed on the supporting member 6, forms a phosphor layer 4*a* having projections. This allows the area in which a phosphor substance is formed, to be increased relative to the unit luminous area and prevents light from leaking out to an adjacent luminous area, resulting in a phosphor layer of with a configuration which can make more effective use of vacuum ultraviolet light generated within the discharge space. Further, the projections are effective in improving mechanical strength of the supporting member 6.

Figure 12:
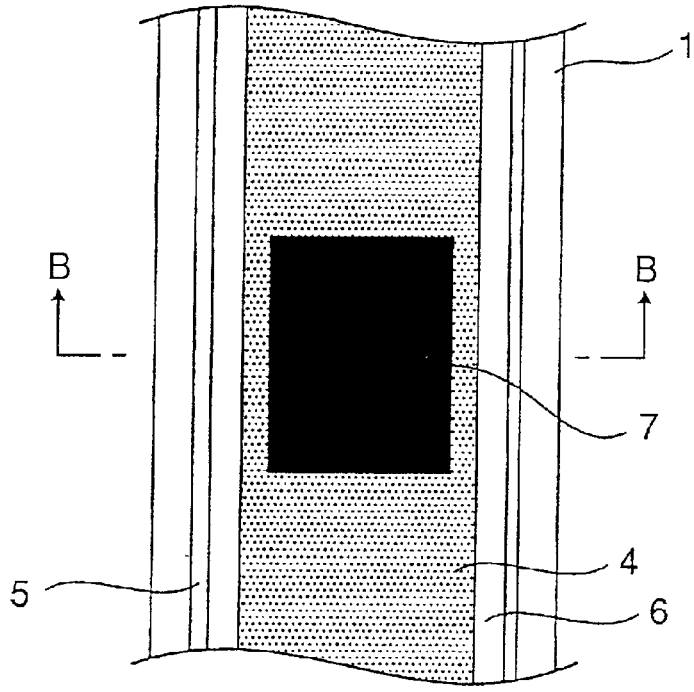
FIGS. 12(*a*) and 12(*b*) are explanatory views illustrating a gas discharge tube in which an induction electrode is formed on a rear surface of the supporting member.
Figure 12:
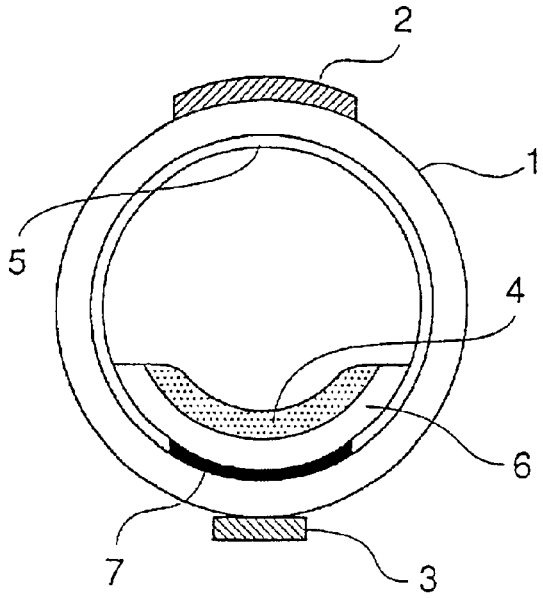

FIGS. 12(*a*) and 12(*b*) are explanatory views illustrating the gas discharge tube 1 in which an induction electrode 7 is formed on a rear surface of the supporting member 6. FIG. 12(*a*) is a plan view illustrating a portion of the gas discharge tube 1 adjacent to the display electrode 2. FIG. 12(*b*) is a cross sectional view taken along line B—B of FIG. 12(*a*).

As shown in the drawings, the induction electrode 7 is formed on the rear surface of the supporting member 6, i.e., on a surface opposite to a surface on which the phosphor layer is formed. Once the induction electrode 7 is thus formed, a capacitive coupling can be formed between the induction electrode 7 and the signal electrode 3 so as to generate selection discharges between the induction electrode 7 and the display electrode 2. This construction is effective if employed when selection discharges between the signal electrode 3 and the display electrode 2 are unstable due to the material or the thickness of the supporting member 6.

Figure 13:
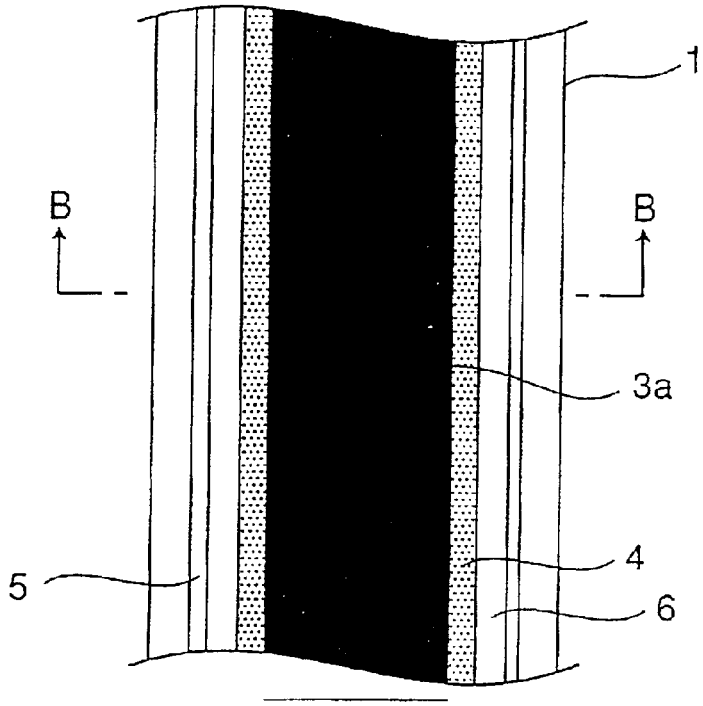
FIGS. 13(*a*) and 13(*b*) are explanatory views illustrating a gas discharge tube in which a signal electrode is formed on the rear surface of the supporting member.
Figure 13:
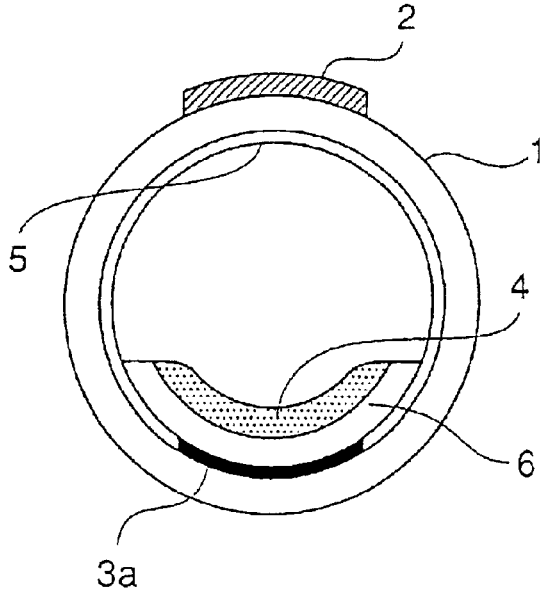

FIGS. 13(*a*) and 13(*b*) are explanatory views illustrating the gas discharge tube 1 in which a signal electrode 3*a* is formed on the rear surface of the supporting member 6. FIG. 13(*a*) is a plan view illustrating a portion of the gas discharge tube 1 adjacent to the display electrode 2. FIG. 13(*b*) is a cross sectional view taken along line B—B of FIG. 13(*a*).

As shown in the drawings, the signal electrode 3*a* is formed on the rear surface of the supporting member 6 i.e., on the surface opposite to the surface on which the phosphor layer is formed. Once the signal electrode 3*a* is thus formed, the fall of an electric potential caused by the supporting member 6 is decreased and the effective area of the signal electrode is increased, resulting in improving stability in discharge characteristics, compared with the case where the signal electrode is formed outside the tube 1. The signal electrode 3*a* on the rear surface is extended outside ends of the tube 1 for application of a voltage.

In the above, explanations were made on the case of a gas discharge tube of a circular cross section in which one supporting member having a phosphor layer of one color is disposed. However, the gas discharge tube of the present invention is not limited to this, and it may be a gas discharge tube with a flat elliptic cross section in which the supporting member has three grooves having phosphor layers of R (red), G (green) and B (blue) for full-color display. In this case, the gas discharge tube with a flat elliptic cross section may be so constructed that, in place of the supporting member having the three grooves, three supporting members having phosphor layers of R, G and B are used.

Embodiment

In the present embodiment, the gas discharge tube illustrated in FIGS. 3(*a*) and 3(*b*) was fabricated. Used was a glass tube 1 of borosilicate glass having a diameter of 1 mm, a wall thickness of 0.1 mm, and a length of 300 mm. The supporting member 6 was also made of borosilicate glass and had a width of 0.7 mm, a glass wall thickness of 0.1 mm, and a length of 300 mm.

The supporting member 6 was coated with a phosphor paste comprising 20% by weight of a phosphor powder, 4% by weight of ethyl cellulose, and 76% by weight of terpineol, dried and fired so as to form the phosphor layer 4 of a thickness of 5 to 30 $\mu$m on the supporting member 6.

Then, the supporting member 6 was inserted into the glass tube 1, and a discharge gas comprising 96% by volume of Ne and 4% by volume of Xe was enclosed at a pressure of 350 Torr, followed by tipping off ends of the supporting member 6 together with ends of the glass tube. Thus, a gas discharge tube 1 was completed.

In the gas discharge tube 1, was disposed a display electrode pair 2 with an width of an electrode of 700 $\mu$m and an inter-electrode spacing of 400 $\mu$m, and display was performed. As a result, contamination of a discharge gas within the tube 1 was able to be reduced and contamination of an electron emission layer 5 formed on wall surfaces of the tube 1 was able to be prevented, so that the discharge characteristics was able to be improved. This resulted in generation of stable discharges.

Thus, by forming the phosphor layer on the supporting substrate and inserting and fixing the supporting substrate into and in the glass tube, contamination of the discharge gas inside the glass discharge tube can be prevented and improvements of the discharge characteristics such as lowering of a firing voltage can be provided. Also, in the case where the signal electrode is formed on the rear surface of the supporting member 6, a firing voltage in selection discharge can be reduced.

According to the present invention, since the phosphor layer is formed on the supporting member independent of the tubular vessel of the gas discharge tube, it is possible to form the phosphor layer easily and perform firing outside the tube for forming the phosphor layer, so that a discharge gas inside the discharge tube can be prevented. This improves the discharge characteristics of a display device which employs the gas discharge tubes, resulting in low voltage driving and prolonged life of the device.

What is claimed is:

1. A display device comprising:

a supporting substrate;

a plurality of gas discharge tubes, arranged parallel to each other on the supporting substrate, each of the gas discharge tubes having a phosphor layer formed within a tubular vessel defining a discharge space including:

a supporting member independent of the tubular vessel, wherein the phosphor layer is formed on the supporting member, and the supporting member is inserted within the discharge space;

wherein the supporting member has projections and the projections are also covered with the phosphor layer; and wherein the supporting member is in contact with the gas discharge tube, a plurality of signal electrodes formed in a longitudinal direction of the gas discharge tubes on a surface of the supporting substrate on which surface the gas discharge tubes are formed, the signal electrodes being in contact with outer walls of the gas discharge tubes; and a plurality of display electrode pairs formed in a direction crossing the gas discharge tubes, the display electrode pairs being in contact with front outer walls of the gas discharge tubes wherein;

luminous areas are formed at areas where the signal electrodes intersect the display electrode pairs; and the projections of the supporting member partition the discharge space on a unit luminous area basis.

2. The gas discharge tube of claim 1, wherein the supporting member is chosen from the group comprising at least one of a glass layer, a metal oxide layer and a metal layer.

3. The gas discharge tube of claim 1, wherein the supporting member is of a shape fixable in the gas discharge tube.

4. The gas discharge tube of claim 1, wherein the gas discharge tube and the supporting member are made of glass and the supporting member is fixed in the gas discharge tube by melting and tipping off ends of the supporting member together with ends of the tube.

5. The gas discharge tube of claim 1, wherein an induction electrode is provided on a surface opposite to a surface on which the phosphor layer is formed.

6. The gas discharge tube of claim 1, wherein an electrode for discharge is provided on a surface opposite to a surface on which the phosphor layer is formed.

7. A display device comprising:

a substrate;

a plurality of gas discharge tubes arranged on the substrate, each of the gas discharge tubes having a phosphor layer formed or a supporting member within a tubular vessel defining the discharge space, wherein the supporting member is inserted within the discharge space;

the supporting member is in contact with the gas discharge tube and has projections which are covered with the phosphor layer;

a plurality of signal electrodes coupled to the gas discharge tubes;

a plurality of display electrode pairs coupled to the gas discharge tubes, wherein the projections of the supporting member partition the discharge space on a unit luminous area basis.

* * * * *

UNITED STATES PATENT AND TRADEMARK OFFICE

CERTIFICATE OF CORRECTION

PATENT NO. : 6,836,064 B2
DATED : December 28, 2004
INVENTOR(S) : Hitoshi Yamada et al.

It is certified that error appears in the above-identified patent and that said Letters Patent is hereby corrected as shown below:

Column 8,
Line 49, change ";" to -- : --

Signed and Sealed this

Twenty-fourth Day of May, 2005

JON W. DUDAS
*Director of the United States Patent and Trademark Office*